US007836960B2

(12) United States Patent
Patel et al.

(10) Patent No.: US 7,836,960 B2
(45) Date of Patent: Nov. 23, 2010

(54) METHOD FOR RUNNING A CONTINUOUS COMMUNICATION LINE THROUGH A PACKER

(75) Inventors: Dinesh R. Patel, Sugar Land, TX (US); Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/969,263

(22) Filed: Jan. 4, 2008

(65) Prior Publication Data

US 2009/0173505 A1 Jul. 9, 2009

(51) Int. Cl.
*E21B 33/12* (2006.01)

(52) U.S. Cl. ..... 166/385; 166/118

(58) Field of Classification Search ..... 166/65.1, 166/179, 385, 387, 186
See application file for complete search history.

(56) References Cited

U.S. PATENT DOCUMENTS 4,820,560 A * 4/1989 Buchwald et al. ..... 428/35.1
6,173,788 B1 * 1/2001 Lembcke et al. ..... 166/387
6,325,144 B1 * 12/2001 Turley et al. ..... 166/120
7,431,082 B2 * 10/2008 Holt et al. ..... 166/241.6
2003/0000875 A1 * 1/2003 Echols et al. ..... 210/85
2007/0012436 A1 1/2007 Freyer

FOREIGN PATENT DOCUMENTS

WO 2004057715 A2 7/2004
WO WO 2004057715 A2 * 7/2004
WO WO 2004/057715 A2 * 8/2004

* cited by examiner

*Primary Examiner*—David J Bagnell
*Assistant Examiner*—James G Sayre
(74) *Attorney, Agent, or Firm*—Brandon S. Clark; Rodney V. Warfford; Edmonds Nolte, PC

(57) ABSTRACT

Techniques are provided for sealing a communication line within a device positioned in a wellbore. The communication line may be continuous and extends through a pass-through arranged generally longitudinally through the device. Swellable sealing material is positioned about and/or over the communication line which is placed in the pass-through of the device to form and maintain a secure seal once the device is submerged in a fluid that causes the swellable sealing material to expand.

17 Claims, 5 Drawing Sheets

METHOD FOR RUNNING A CONTINUOUS COMMUNICATION LINE THROUGH A PACKER

BACKGROUND

The invention relates generally to a system and method for running a continuous communication line through devices in a wellbore.

In the production of hydrocarbon fluids and in various other subterranean applications, communication lines, e.g. hydraulic control lines, electrical cables, fiber optic lines are used to convey signals and/or power between subterranean locations and surface locations. For example, communication lines are run within wellbores to convey signals to and/or from well equipment deployed within the wellbore. The well equipment has many forms for use in a variety of applications, including fluid production procedures, well treatment procedures, and other well related procedures.

Many of these applications benefit from sealing off sections of the well with, for example, packers that may be deployed at one or more points along the wellbore. Generally, a communication line segment is deployed within each section and axially run through the packers. As a result, this prevents running a continuous communication line into the wellbore so that each segment of communication line must be joined to the next segment using connectors. The connectors e.g. hydraulic, electrical, fiber optic or any other type may be made up at the surface as the well equipment is run into the wellbore. However, assembling communication lines with the connectors and testing the connectors to check proper functioning uses valuable rig time. Furthermore, communication lines are assembled with the connectors under surface conditions but once downhole, the connectors may be exposed to downhole conditions, such as high pressure, elevated temperature, vibration, shock, and various corrosive fluids. These conditions may loosen the connectors, or may effect the pressure sealing capability and functionality of the connectors.

SUMMARY

In general the embodiment of invention provides a system and method for routing a continuous communication line through a packer or other well related device where formation of a seal is desirable. The packer or other device is designed with a pass-through that enables the communication line to extend through the device from one wellbore zone to another. An expandable or swellable material is deployed about the communication line to form and maintain a seal between the communication line and the packer or other device. The swellable material expands upon exposure to a specific fluid found in the wellbore.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the embodiments of the invention. However, it will be understood by those of ordinary skill in the art that the embodiments of the invention may be practiced without these details and that numerous variations or modifications from the described embodiments may be possible.

The embodiment of the invention relates to sealing a communication line, such as a control line, as it passes through devices in a well. For example, in some well applications, wellbore devices, e.g. swellable zonal isolation packers, are utilized to create zones within the wellbore. However, the well applications also can benefit from the transfer of signals downhole and/or uphole via one or more communication lines. As described more fully below, the communication lines pass in a longitudinal direction through the wellbore device, e.g. packer, and are sealed with respect to the device to maintain zonal separation.

Packers and other devices can be utilized more effectively in such applications when a dependable communication line seal is formed and maintained. This ability to successfully maintain a seal also enables the use of a variety of communication lines in many types of well applications. For example, the communication lines can be used to deliver control signals to downhole devices in isolated wellbore zones via, for example, electrical, optical and hydraulic inputs. However, the communication lines also can be used to carry signals from many types of downhole sensors. In other applications, the communication lines can be utilized to deliver chemicals to various zones along the wellbore. These are just a few examples of communication line usage in specific wellbore applications that benefit from a securely scaled communication line with respect to the surrounding packer or other wellbore device.

Figure 1:
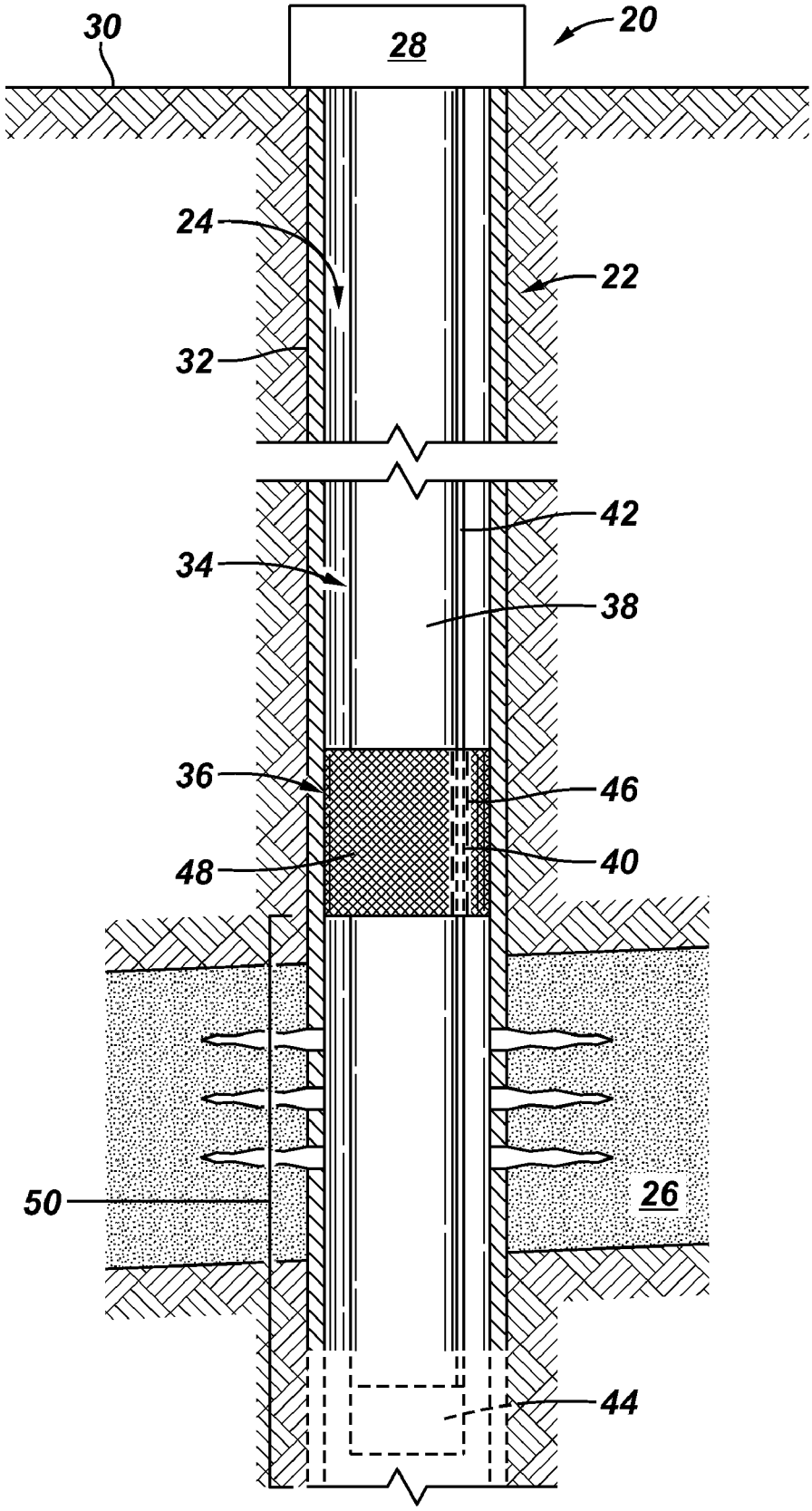
FIG. 1 is a schematic view of a well in which a device with a communication line has been positioned in a wellbore, according to an embodiment of the present invention.

Referring generally to FIG. 1, an embodiment of a well system 20 is illustrated as utilizing a sealed communication line. Well system 20 is used in a well 22 comprising a wellbore 24 drilled into a formation 26. Wellbore 24 extends downwardly from a wellhead 28 positioned at a surface 30 of the earth. In many applications, wellbore 24 is lined by a casing 32 which, in production applications, may be perforated to enable fluid flow from formation 26 into wellbore 24 for production to a desired collection location.

In the embodiment of FIG. 1, well system 20 comprises well equipment 34 illustrated as extending downwardly from wellhead 28 and disposed within wellbore 24. The well equipment can be designed for many types of well applications, including production related procedures, well treatment procedures, well construction procedures and other well related procedures. Additionally, the specific components of well equipment 34 can vary substantially from one well application to another. In many of these applications, however, there is great benefit in the ability to seal communication lines as they pass through specific devices.

In the embodiment illustrated, well equipment 34 comprises a well device 36 deployed on a tubing string 38. The well device 36 includes a pass-through 40 which provides a generally axial or longitudinal passage through device 36. One or more communication lines 42 which may be continuous may extend downwardly through pass-through 40 to carry signals downhole and/or uphole. As discussed above, the communication line or lines may comprise electrical lines, optical lines, fluid lines, e.g. hydraulic lines, or other types of communication lines. It is understood that the communication line may be continuous and designed to pass through the devices from one wellbore zone to another without cutting through the communication line and joining with connectors, or segmented and connected to each other using connectors. In many applications, the one or more communication lines 42 comprise control lines to carry control signals downhole for controlling a downhole device, e.g. controlled device 44. The communication lines 42 are sealed within pass-through 40 by a swellable sealing material 46 that expands upon contact with specific fluid, such as a hydrocarbon based fluid found within an oil production well. Upon contact with the specific fluid, the swellable sealing material 46 expands to effectively seal the communication line 42 in the surrounding well device 36.

In the example illustrated, well device 36 comprises a packer 48 for forming a seal between tubing string 38 and the surrounding casing 32. Packer 48 is representative of a variety of packers and is used to isolate zones within wellbore 24, such as zone 50 disposed below packer 48. Additionally, multiple packers can be used to isolate a plurality of zones within wellbore 24. It is important to seal the communication line or lines 42 as they pass through each packer 48 to maintain the integrity of the zonal isolation. In this example, a packer comprised of swellable material is disclosed however, it is understood that other types of packers which are not comprised of swellable material may be used in the embodiment of the invention.

Swellable sealing material 46 can be formed from various materials that sufficiently swell or expand in the presence of specific fluids, such as hydrocarbon based fluids. Examples of materials that may be used in the applications described herein are elastomers that swell when placed in contact with hydrocarbons. Such swell elastomers are well known and available to the petroleum production industry.

In FIGS. 1-16, several examples of how swellable sealing material 46 may be utilized in wellbore devices are illustrated in schematic form. The schematic illustrations are generally arranged as top views and partial side views showing the communication line extending longitudinally through well device 36. In each example, the swellable sealing material 46 is located for exposure to well fluid when well equipment 34 is run into wellbore 24. Exposure to the well fluid causes the swellable sealing material 46 to expand and thereby seal the pass-through regions through which the communication lines extend.

Figure 2:
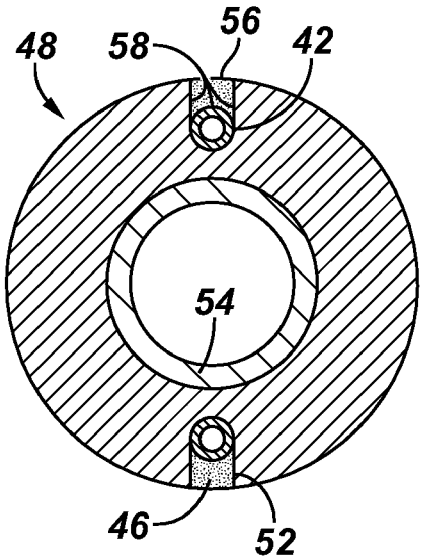
FIG. 2 is a schematic top view of one embodiment of the device illustrated in FIG. 1 with a communication line and sealing material, according to an embodiment of the present invention.
Figure 3:
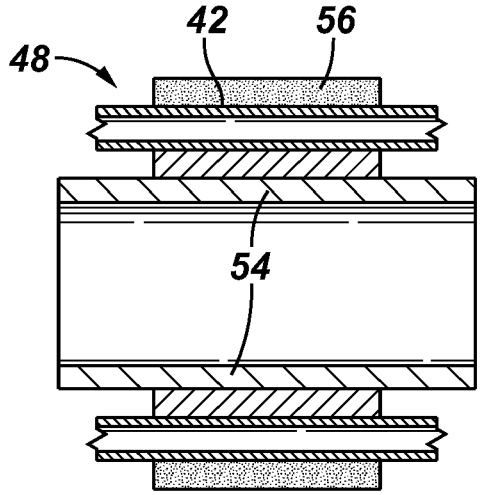
FIG. 3 is a schematic side view of the embodiment of the device illustrated in FIG. 2.

Referring first to FIGS. 2-3, an embodiment is illustrated in which pass-through 40 comprises a groove 52 that extends in a generally axial direction through packer 48. The groove 52 is disposed externally to a packer mandrel 54, and the groove is sized to receive communication line 42 therethrough. The communication line 42 is placed in the groove 52 and the swellable sealing material 46 is placed on top of the communication line to form a cover 56 which fills in and seals the remaining part of the groove. An adhesive 58 may be used to retain the cover to a top of the communication line 42 and side walls of the groove 52. Thus, when packer 48 is moved into wellbore 24 and submerged in wellbore fluid, the swellable sealing material 46 expands and seals the communication line 42 within the groove and creates a seal that is maintained between the cover, the packer 48 and the casing.

It should be noted that in this embodiment and the following illustrated embodiments, the recitation of communication line 42 is meant to include one or more communication lines 42. Additionally, communication line 42 may comprise one or more types of communication lines, depending on the specific well application. It is also understood that using an adhesive is not necessary to form an effective seal for the communication line.

Figure 4:
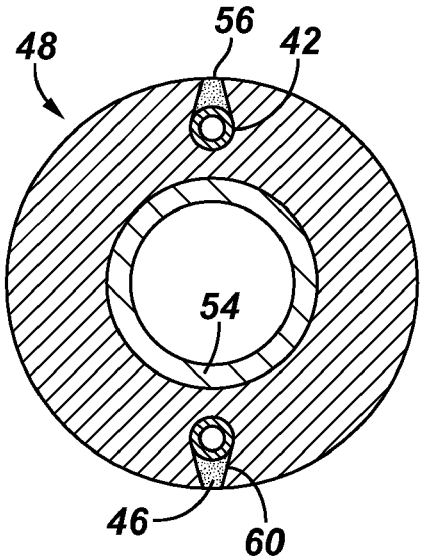
FIG. 4 is a schematic top view of another embodiment of the device illustrated in FIG. 1.
Figure 5:
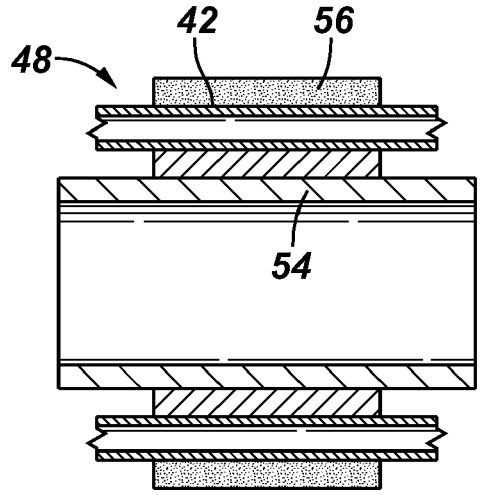
FIG. 5 is a schematic side view of the embodiment of the device illustrated in FIG. 4.
Figure 6:
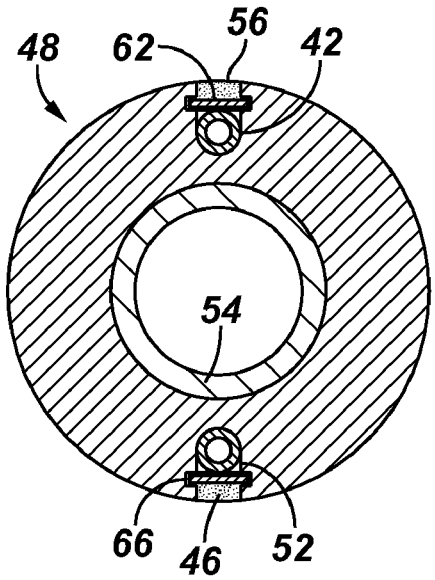
FIG. 6 is a schematic top view of another embodiment of the device illustrated in FIG. 1.
Figure 7:
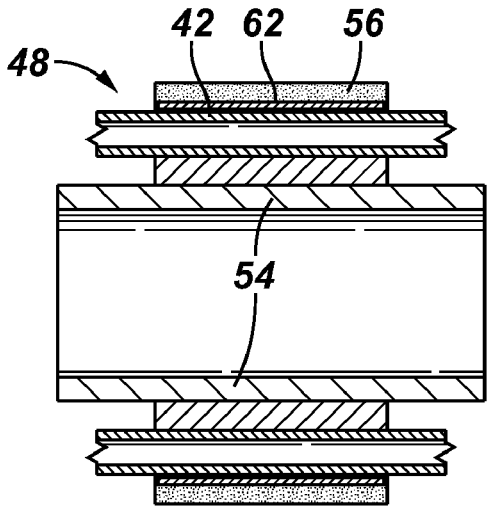
FIG. 7 is a schematic side view of the embodiment of the device illustrated in FIG. 6.
Figure 8A:
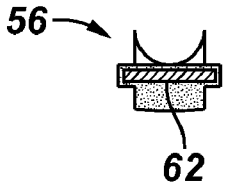
FIG. 8A is a schematic top view of a cover having a stiffness member in the embodiment of the device illustrated in FIG. 6.
Figure 8B:
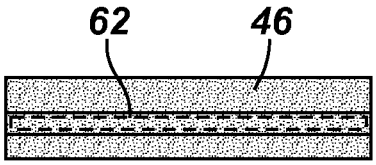
FIG. 8B is a schematic side view of the cover having the stiffness member in the embodiment of the device illustrated in FIG. 6.

In an embodiment is illustrated in FIGS. 4-5, the pass-through 40 comprises a dove tail-shaped groove 60 that extends in a generally axial direction through packer 48. As in the embodiment above, the dove tail-shaped groove 60 is disposed externally to a packer mandrel 54, and the groove is sized to receive communication line 42 therethrough. The communication line 42 is placed in the dove tail-shaped groove 60 and the swellable sealing material 46 is placed on top of the communication line to form the cover 56 which fills in and seals the remaining part of the dove tail-shaped groove 60. The cover 56 may be dove tail-shaped and slides into the dove tail-shaped groove 60 to fit together compactly in the dove tail-shaped groove. Adhesive 58 may be used to further enhance retention of the cover 56 in the dove tail-shaped groove 60 however use of adhesive is not required. The sealing material 46 expands and seals the communication line 42 within the dove tail-shaped groove 60 and creates a seal that is maintained between the cover 56 and the packer 48 when packer 48 is moved into wellbore 24 and submerged in wellbore fluid. The dovetail-shaped groove enhances retention of cover in the groove.

In the embodiment illustrated in FIGS. 6-9, a stiffness member 62 may be provided in the cover 56 so that the cover may be slid into the groove 52 in an easy manner. As shown in FIGS. 8A and 8B, the stiffness member 62 and the cover 56 may be molded together as a unitary member such that the swellable sealing material encloses the stiffness member. However, it is understood the stiffness member and cover may be formed as separate members. The stiffness member 62 may be metal and slightly wider than a width of the groove 52 that extends in a generally axial direction through packer 48 as in the embodiment shown in FIGS. 2-3. The groove 52 is disposed externally to a packer mandrel 54, and the groove is sized to receive communication line 42 therethrough.

Figure 9:
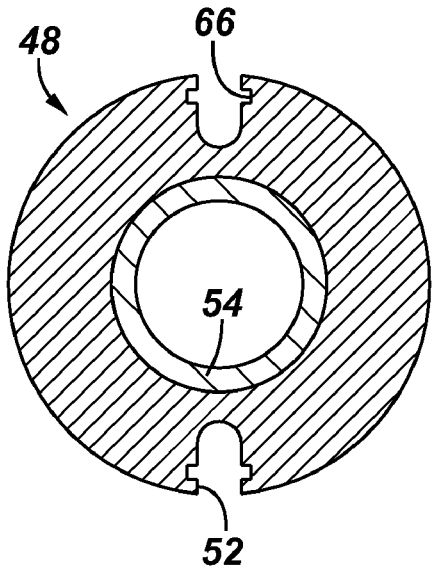
FIG. 9 is a schematic top view of the embodiment of the device illustrated in FIG. 6 showing a groove and a slot.

Also disposed externally to the packer mandrel and a location of where the communication line is received in the groove 52 is a notch 66, shown in FIG. 9, for retaining the stiffness member 62. The notch 66 extends in a generally axial direction through the packer 48 and may be slightly wider than a width of the groove 52. The communication line 42 is placed in the groove 52 and the cover 56 is then slid in the groove so that the stiffness member 62 mates with the notch 66 in the groove. The stiffness member 62 in engagement with the notch 66 enhances retention of cover in the groove 52 however an adhesive may be used to further enhance retention of the cover 56 in groove. When packer 48 is moved into wellbore 24 and submerged in wellbore fluid, the cover expands and seals the communication line 42 within the groove to create a seal that is maintained between the cover 56, the packer 48 and the casing 32.

Figure 10:
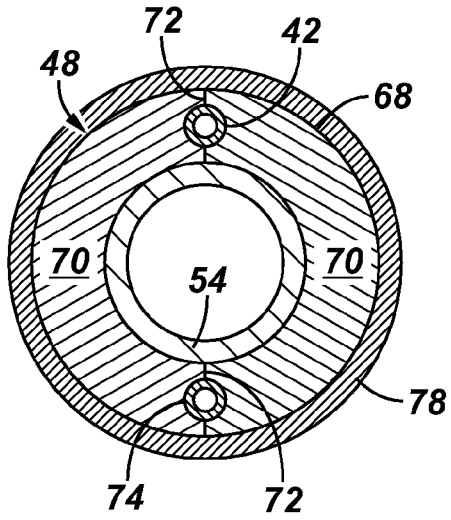
FIG. 10 is a schematic top view of another embodiment of the device illustrated in FIG. 1.
Figure 11:
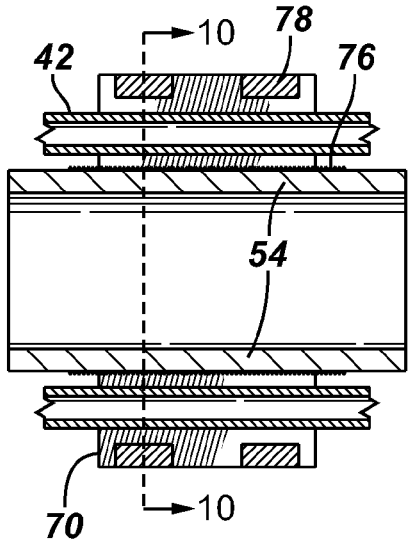
FIG. 11 is a schematic side view of the embodiment of the device illustrated in FIG. 10.

In the embodiment illustrated in FIGS. 10-11, the packer may be constituted by two or more segments encircling the packer mandrel. For example, swellable sealing material 46 may be formed as a sleeve 68 wrapped about packer mandrel 54 having sleeve segments 70 which include splits 72 that enable the sleeve of swelling material to be selectively wrapped about all or a portion of mandrel 54. The sleeve segments 70 may include cut-outs 74 which are half moon shaped at each end of the sleeve segments to create the pass-through 40, or a circular opening, for retaining and securely sealing the communication line 42 within the packer 48 upon swelling of sleeve. As in the embodiment shown in FIG. 2, an adhesive may be added to each end of the sleeve segments for securing the ends of the sleeve segments together.

The packer mandrel 54 may also include gripping members 76, or corrugations, at the location where the sleeve segments 70 are placed on the packer mandrel. The gripping members 76 grip and secure the sleeve segments 70 on inner surfaces of the sleeve segments and prevents the packer from any movement. A plurality of clamps 78 may also be used for securely holding together outer surfaces of the sleeve segments. The plurality of clamps 78 may be rubber which swells with the sleeve, or metal which allows a middle section of the sleeve to swell. By wrapping the communication line 42 and mandrel 54 with the sleeve 68 and clamps 78, communication line 42 is securely held in place during deployment of well equipment 34. When packer 48 is lowered into well 22, well fluid causes the sleeve 68 to expand and seal around communication line 42.

Figure 12:
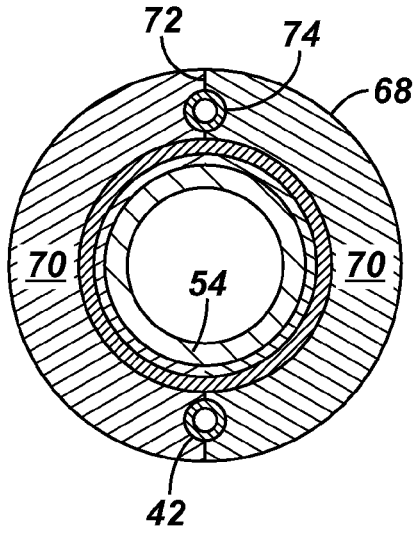
FIG. 12 is a schematic top view of another embodiment of the device illustrated in FIG. 1.
Figure 13:
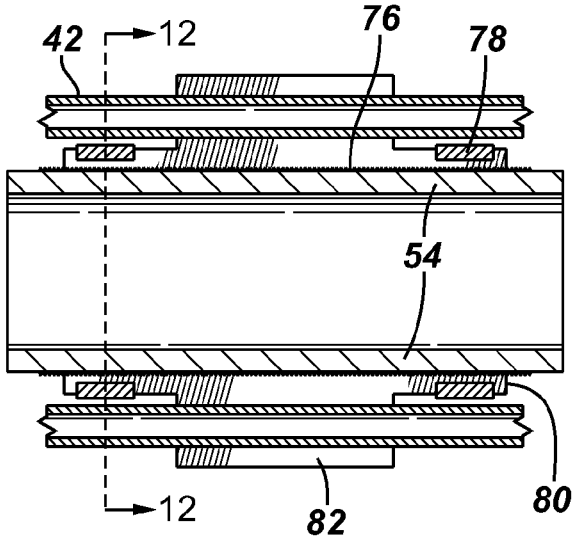
FIG. 13 is a schematic side view of the embodiment of the device illustrated in FIG. 12.

In the embodiment illustrated in FIGS. 12-13, the packer may be constituted by two or more segments encircling the packer mandrel. As in the previous embodiment shown in FIGS. 10-11, swellable sealing material 46 may be formed as a sleeve 68 wrapped about packer mandrel 54 having sleeve segments 70 which include splits 72 that enable the sleeve of swelling material to be selectively wrapped about all or a portion of mandrel 54. However, the sleeve segments includes end sections 80 which may be longer than a middle section 82 of the sleeve segments 70 as depicted in FIG. 13. The sleeve segments 70 include cut-outs 74 for retaining and securely sealing the communication line 42 within the packer 48 upon swelling of sleeve. The packer mandrel may also include the gripping members 76 at the location where the sleeve segments 70 are placed on the packer mandrel for securing the sleeve segments on inner surfaces of the sleeve segments. The plurality of clamps 78 may also be used for securely holding together outer surfaces of the sleeve segments. The plurality of clamps may be placed at the end sections 80 of the sleeve segments allowing the packer to swell at the middle section 82. An adhesive may be added to each end of the sleeve segments for securing the ends of the sleeve segments together.

Figure 14:
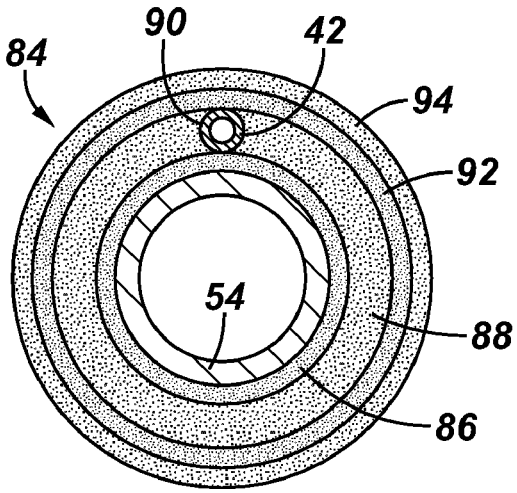
FIG. 14 is a schematic top view of another embodiment of the device illustrated in FIG. 1.
Figure 15:
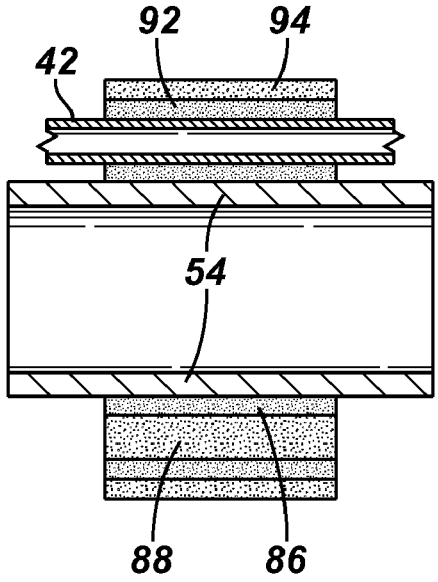
FIG. 15 is a schematic side view of the embodiment of the device illustrated in FIG. 14.
Figure 16:
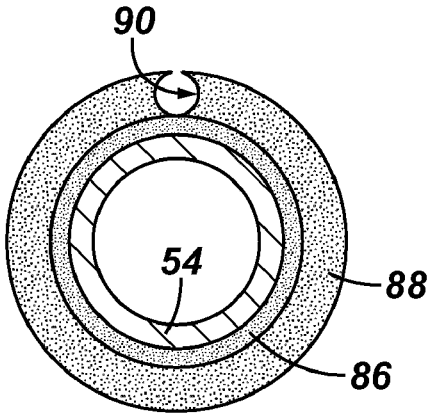
FIG. 16 is a schematic top view of the embodiment of the device illustrated in FIG. 14 showing a slot.

Another embodiment is illustrated in FIGS. 14-16. In this embodiment, the packer mandrel may be wrapped with a plurality of layers of swellable sealing material 84 for sealing the control line in the packer. As illustrated in FIG. 16, the packer mandrel is wrapped with a first layer of swellable sealing material 86. A second layer of swellable sealing material 88 is wrapped around the first layer of swellable sealing material 86. However, the second layer of swellable sealing material 88 includes at least one pass-through 40 which comprises a slot 90 and receives the communication line 42 therethrough. The slot 90 may be formed fully within the second layer of swellable sealing material 88 or along an exterior surface of the second layer of swellable sealing material. The second layer of swellable sealing material 88 may then be covered with a third layer of swellable sealing material 92 and a fourth layer of swellable sealing material 94. The slot 90 is sized to receive communication line 42 such that upon exposure to specific fluids, the expansion of layers of swellable sealing material 84 is sufficient to seal communication line 42 within the well device 36 and the plurality of layers of swellable sealing material to each other. It is understood that the slot may be placed in other layers of the plurality of layers of swellable sealing material as long as the communication line is securely and effectively sealed within the packer. It is also understood that the plurality of layers of swellable sealing material may be less or more than four layers of swellable sealing material or one continuous strip of swellable sealing material which is wrapped around the mandrel such that layers are formed as long as the packer is securely and effectively sealed within the casing.

In the embodiments shown in FIGS. 1-16, the swellable sealing material 46 may be formed in a variety of shapes and configurations. This enables the sealing of pass-throughs having many shapes and configurations, which, in turn, facilitates the use of communication lines in many types of packers.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a well, comprising:

a packer having a pass-through region, the pass-through region comprising:

a generally axially oriented groove; and a notch located within the groove;

a communication line extending through the pass-through region; and a swellable material disposed along the communication line within the pass-through region.

2. The system as recited in claim 1, wherein the groove is dove tail-shaped groove.

3. The system as recited in claim 1, wherein the swellable material comprises a cover.

4. The system as recited in claim 3, further comprising a stiffness member which is provided in the cover.

5. The system as recited in claim 3, further comprising using an adhesive for sealing the cover.

6. The system as recited in claim 1, wherein the packer comprises a packer mandrel along which the communication line extends, and the swellable material comprises sleeve segments wrapped around the communication line and the packer mandrel.

7. The system as recited in claim 6, further comprising gripping members on the packer mandrel at a location where the sleeve segments are placed on the mandrel.

8. The system as recited in claim 6, further comprising clamps for securing the sleeve segments on the mandrel.

9. The system as recited in claim 1, wherein the packer comprises a sleeve having splits to receive the communication line.

10. The system as recited in claim 1, wherein the communication line is continuous.

11. A method of providing communication in a wellbore, comprising:

providing a packer with a pass-through region comprising a groove and a notch defined at least partially within the groove;

routing a communication line through the pass-through region; and sealing the communication line in the pass-through region with a swellable material that swells upon exposure to specific fluids, wherein the packer comprises:

a cover disposed about the swellable material; and a stiffness member disposed within the cover and received into the notch.

12. The method as recited in claim 11, wherein the pass-through region is formed along a mandrel of the packer.

13. The method as recited in claim 11, wherein the pass-through region is formed as cut-outs in sleeve segments disposed about a packer mandrel.

14. The method as recited in claim 11, wherein the swellable sealing material comprises a plurality of layers of swellable sealing material.

15. The method as recited in claim 11, wherein the groove is generally axially oriented.

16. The method as recited in claim 11, wherein the groove is generally axially oriented and dove tail-shaped.

17. The method as recited in claim 11, wherein the communication line is continuous.

* * * * *